US005313754A

United States Patent [19]

Jensen

[11] Patent Number: 5,313,754

[45] Date of Patent: May 24, 1994

[54] MAGNETIC CORNER PROTECTOR

[75] Inventor: William I. Jensen, Sheridan, Mont.

[73] Assignee: Manufacturing Technologies, Inc., Sheridan, Mont.

[21] Appl. No.: 10,581

[22] Filed: Jan. 28, 1993

[51] Int. Cl.[5] ..... E04B 1/00

[52] U.S. Cl. ..... 52/255; 52/232; 52/DIG. 4; 52/287.1

[58] Field of Search ..... 52/232, 255, 256, 257, 52/287 R, DIG. 4, 288, 717.03, 718.01, 716.1, 244, 245, D12; 248/206.5

[56] References Cited

U.S. PATENT DOCUMENTS

| | | | |
|---|---|---|---|
| 830,792 | 9/1906 | Kuhne | 52/257 |
| 2,666,352 | 1/1954 | Philips | 248/206.5 |
| 3,292,328 | 12/1966 | Lewis et al. | 52/DIG. 4 |
| 3,686,815 | 8/1972 | Von Bose | 52/DIG. 4 |
| 4,250,596 | 2/1981 | Hara et al. | 52/DIG. 4 |
| 4,638,618 | 1/1987 | Iesaka et al. | 52/509 |
| 4,706,426 | 11/1987 | Rumsey | 52/287 R |
| 4,709,522 | 12/1987 | Carnahan | 52/DIG. 4 |
| 4,863,774 | 9/1989 | Tucker | 52/417 |
| 5,048,247 | 9/1991 | Weldy | 52/255 |

*Primary Examiner*—Carl D. Friedman
*Assistant Examiner*—Winnie Yip

[57] ABSTRACT

A protective guard to be used in conjunction with a structural corner or corner edge having metal beading or metal backing is provided and consists of an injection molded, elongated resilient one-piece body divided longitudinally into two equal halves connected by integrated living hinges. The protective guard is secured in place by a plurality of integrated oriented multiple pole ceramic magnets. The protective guard includes a continuous edge border which abuts the surface of the structural corner or corner edge such that the plurality of magnets are in close proximity but not contact with the structural corner or corner edge.

5 Claims, 3 Drawing Sheets

MAGNETIC CORNER PROTECTOR

BACKGROUND OF THE INVENTION

1. Field or the Invention

The present invention relates to protective guards for structural corners and corner edges and particularly to removable protective guards for use as a shield on a wall, piece of furniture or the like having metal beading or metal backing.

2. Prior art

In recent years, use of metal for framing and backing has escalated in construction, and particularly in building interior construction. For example, metal studs are frequently used for interior framing and metal beading or metal backing has long been used for maintaining the shape and integrity of structural corners over sheetrock and the like. Typically, the metal beading or metal backing on structural corners is covered in finished fashion prior to the laying of carpet. Unfortunately, carpet layers and the like are faced with a finished structural corner when measuring, cutting and laying the carpet. For such work, the need has long been felt for appropriate corner protection which is inexpensive, removable, reusable and which does not mar the finished surface when in use, being attached or removed.

Prior art discloses corner protectors which function mainly to protect objects striking a corner with mainly incidental provision for avoiding marring the appearance of the corner when the corner protector is attached or removed. Prior art generally teaches away from removable corner protectors which avoid marring the protected corner upon attachment or removal. Typical of corner protector attachment are Velcro strips, suction means, magnetic means, adhesive and tethering tapes or ties, all of which immediately attach or abut directly against the finished surface of the corner. Removal of such corner protectors typically mars the surface, requiring refinishing for appearance.

Prior art generally discloses corner protectors having body structure extending outward from the corner which functions to absorb impact. Such body structure can result in inaccurate corner measurement when working around the corner, such as carpet laying.

With the increased use of abrasive jute backed carpets, carpet layers face a unique situation when laying carpet in the vicinity of structural corners and corner edges. Typically, a structural corner will have metal beading to maintain the shape and integrity of the corner and particularly the corner edge. The corner will be finished over the metal beading prior to carpet being laid. When the carpet is laid to accommodate the corners, the backing of the carpet typically abuts the finished corner and the carpet backing mars the finished exterior of the corner and to some degree the adjacent walls. In addition, in protecting the corner, typical corner protectors mar the finish of the corner being protected when being attached or removed.

The available protectors do not provide the novel improvements of the invention herein disclosed.

OBJECTS OF THE INVENTION

It is a primary object of the present invention to provide a protective guard for structural corners and corner edges having metal beading or metal backing that will overcome the shortcomings of the prior art devices.

It is another object of the present invention to provide a protective guard for structural corners and corner edges having metal beading or metal backing which is removable.

It is another object of the present invention to provide a protective guard for structural corners and corner edges having metal beading or metal backing which can be repeatedly mounted onto the structural corner or corner edge and removed without damage to the underlying corner structure finish.

It is another object of the present invention to provide a protective guard for structural corners and corner edges having metal beading or metal backing which can be easily manufactured at a relatively low cost.

It is another object of the present invention to provide a protective guard for structural corners and corner edges having metal beading or metal backing which can be repeatedly used to protect structural corners or corner edges of varying angles.

SUMMARY OF THE INVENTION

The protective guard of the present invention is utilized in conjunction with a structural corner or corner edge having metal beading or metal backing. The protective guard includes an injection molded, elongated resilient one-piece body. The injection molded, elongated resilient one-piece body is divided longitudinally into two equal halves, which halves are connected by means of a plurality of living hinges integrated into the body. The plurality of living hinges allow the protective guard to form an angle which corresponds to the configuration of the underlying structural corner or corner edge. A plurality of oriented multiple pole ceramic magnets are integrated into the injection molded, elongated resilient one-piece body in spaced relation. The injection molded, elongated resilient one-piece body has a continuous edge border which border is perpendicular to the plane of the body and which abuts the surface of the structural corner or corner edge when the protective guard is in use in such alignment that the plurality of magnets are in close proximity to but not contact with the structural corner or corner edge.

BRIEF DESCRIPTION OF THE DRAWINGS

Further objects and advantages of the present invention can be found in the detailed description of the preferred embodiments when reviewed in conjunction with the accompanying drawings in which.

DETAILED DESCRIPTION OF THE PREFERRED EMBODIMENTS

Figure 1:
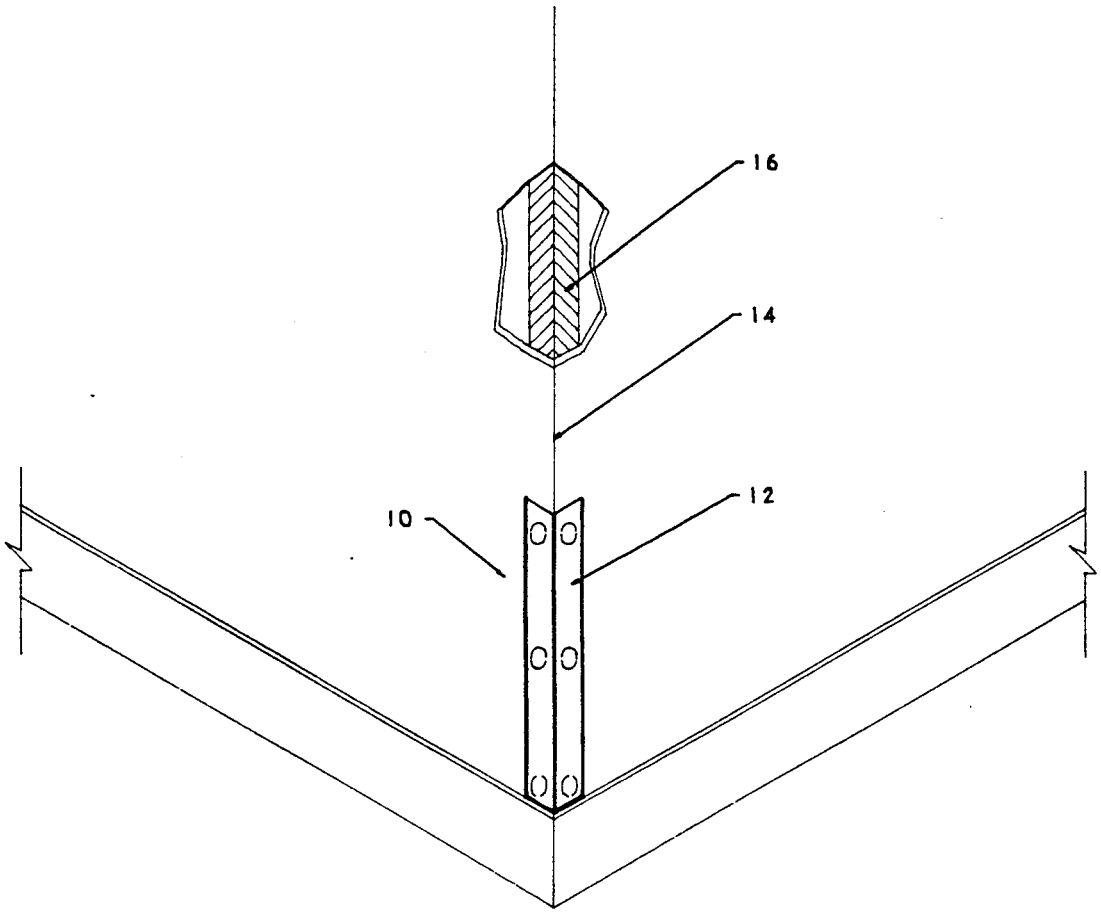
FIG. 1 illustrates a perspective view of a wall corner with the invention attached thereto.
Figure 2:
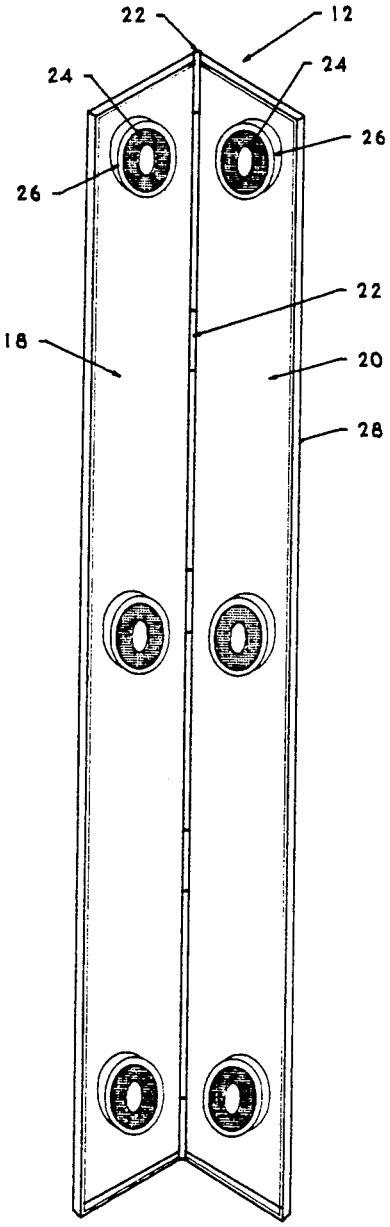
FIG. 2 illustrates a perspective view of the surface of the invention attaching to a wall angled to accomodate a wall corner.
Figure 3:
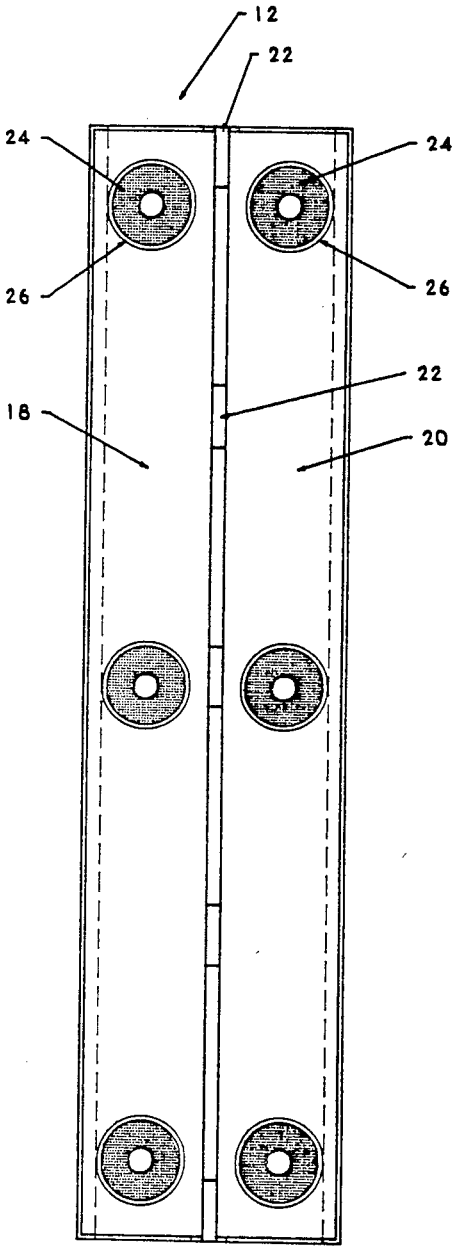
FIG. 3 illustrates a perspective view of the surface of the invention attaching to a wall in flat plane.
Figure 4:
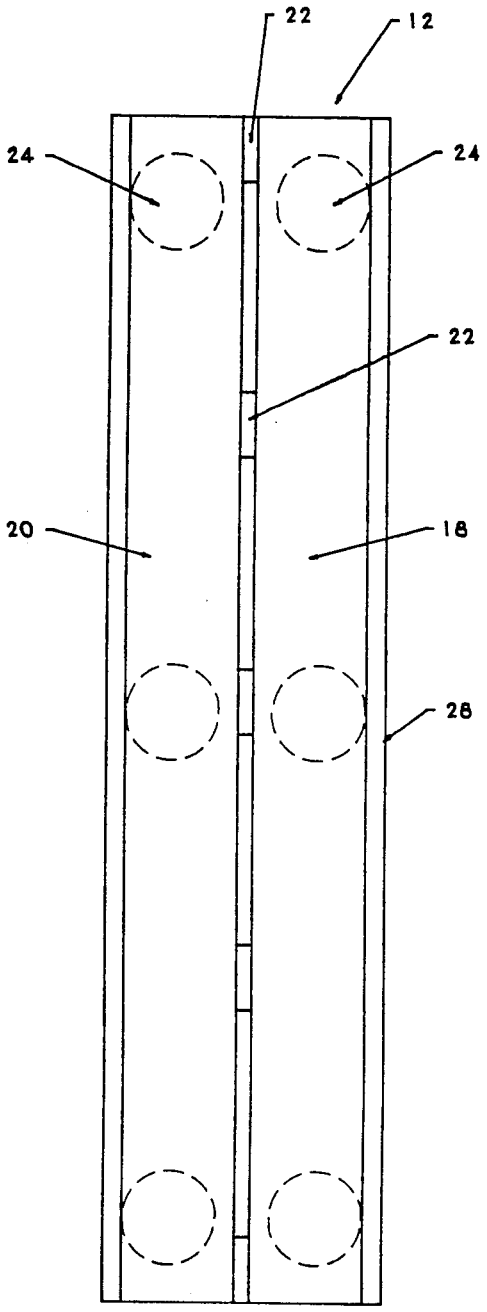
FIG. 4 illustrates a perspective view of the surface of the invention away from a wall in flat plane.
Figure 5:
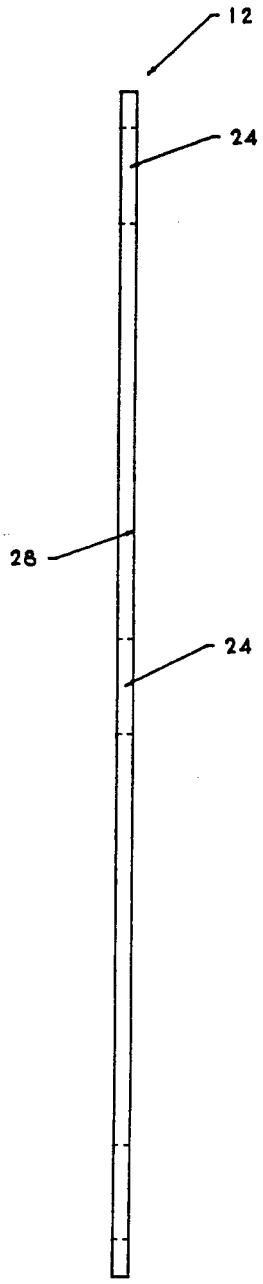
FIG. 5 illustrates a side view of the invention.
Figure 6:
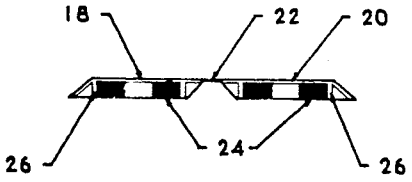
FIG. 6 illustrates a top view of the invention.

Turning now descriptively to the drawings, in which similar reference characters denote similar elements throughout the several views, FIG. 1 illustrates a protective guard 10 consisting of an injection molded, elongated resilient one-piece body 12 attached to and shielding on a structural corner or corner edge 14. The structural corner or corner edge 14 has metal beading or metal backing 16 to maintain the shape and integrity of the corner and particularly the corner edge.

FIGS. 2 through 6 illustrate the injection molded, elongated resilient one-piece body 12 being divided longitudinally into equal halves 18, 20. The equal halves 18, 20 are connected by means of a plurality of living hinges 22 integrated into the injection molded, elongated resilient body 12. In the preferred embodiment, the plurality of living hinges 22 comprises five living hinges integrated into the injection molded, elongated resilient body 12. The plurality of living hinges 22 integrated into the injection molded, elongated resilient body 12 consist of natural polypropylene which material allows for longer living hinge life.

A plurality of oriented multiple pole ceramic magnets 24 are integrated into the injection molded, elongated resilient body 12 in spaced relation. In the preferred embodiment, the plurality of oriented multiple pole ceramic magnets 24 comprises six oriented multiple pole ceramic magnets integrated into the injection molded, elongated resilient body 12 in spaced relation. The plurality of oriented multiple pole ceramic magnets 24 are integrated into the injection molded, elongated resilient body 12 by means of a press fit locking natural polypropylene receptacle 26 integrated into the injection molded, elongated resilient body 12. The injection molded, elongated resilient body 12 has a continuous edge border 28. The continuous edge border 28 abuts the wall surface of a structural corner or a corner edge 14 when the protective guard 10 is in use in such alignment that the plurality of oriented multiple pole ceramic magnets 24 are in close proximity to but not contact with the structural corner or corner edge. In one embodiment, such close proximity between the plurality of oriented multiple pole ceramic magnets 24 and the wall surface of the structural corner or corner edge 14 consists of 0.010 inches.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A protective guard for a structural corner or corner edge having metal beading or metal backing, comprising:

an injection molded, elongated resilient body having a first and second elongated portions for engaging and covering the structural corner edge having metal beading or metal backing, a plurality of living hinges integrated and connecting the first and second elongated portions of the injection molded, elongated resilient body, a plurality of oriented, multiple pole ceramic magnets integrated into the first and second elongated portions of the injection molded, elongated resilient body, a continuous edge border integrated into the injection molded, elongated resilient body, which edge border supports the injection molded, elongated resilient body in such alignment that the plurality of magnets are in close proximity to but not contact with the structural corner or corner edge having metal beading or metal backing.

2. The protective guard of claim 1 wherein the plurality of living hinges integrated into the injection molded, elongated resilient body consist of natural polypropylene.

3. The protective guard of claim 1 wherein the plurality of oriented multiple pole ceramic magnets integrated into the injection molded, elongated resilient body are integrated into the injection molded, elongated resilient body by means of a press fit locking natural polypropylene receptacle integrated into the injection molded, elongated resilient body.

4. The protective guard of claim 1 wherein said plurality of living hinges further comprise five living hinges integrated into the injection molded, elongated resilient body.

5. The protective guard of claim 1 wherein said plurality of oriented multiple pole ceramic magnets further comprises six oriented multiple pole ceramic magnets integrated into the injection molded, elongated resilient body.

* * * * *